US006532845B1

(12) United States Patent
Reiman

(10) Patent No.: US 6,532,845 B1
(45) Date of Patent: Mar. 18, 2003

(54) METHOD OF AND AN APPARATUS FOR TIGHTENING THREADED CONNECTORS

(75) Inventor: Jeff Reiman, Harrington Pk., NJ (US)

(73) Assignee: Unex Corporation, Mahwah, NJ (US)

( * ) Notice: Subject to any disclaimer, the term of this patent is extended or adjusted under 35 U.S.C. 154(b) by 0 days.

(21) Appl. No.: 09/563,868

(22) Filed: May 3, 2000

(51) Int. Cl.[7] ..... B25B 13/46
(52) U.S. Cl. ..... 81/57.39; 81/60; 81/57.44
(58) Field of Search ..... 81/467, 57.39, 81/57.44, 60, 61; 73/1.19, 1.21, 1.22, 1.23, 1.24, 1.57, 1.71, 1.68, 862.25, 862.08, 862.23

(56) References Cited

U.S. PATENT DOCUMENTS

| | | | | | |
|---|---|---|---|---|---|
| 4,387,611 | A | | 6/1983 | Junkers | |
| 4,516,445 | A | | 5/1985 | Wlodarski | |
| 4,685,050 | A | * | 8/1987 | Polzer et al. | 73/761 |
| 4,938,109 | A | * | 7/1990 | Torres et al. | 81/467 |
| 4,941,362 | A | * | 7/1990 | Tambini | 73/862.23 |
| 5,007,153 | A | * | 4/1991 | Junkers | 73/862.25 |
| 5,617,771 | A | | 4/1997 | Landrum | |
| 6,112,622 | A | * | 9/2000 | Reiman | 81/57.39 |
| 6,311,585 | B1 | * | 11/2001 | Jamra et al. | 81/57.39 |

FOREIGN PATENT DOCUMENTS

| | | |
|---|---|---|
| EP | 0 297 515 A1 | 1/1989 |
| GB | 2 082 491 A | 3/1982 |

* cited by examiner

*Primary Examiner*—Lee Wilson
(74) *Attorney, Agent, or Firm*—Michael J. Striker

(57) ABSTRACT

For tightening threaded connectors, a plurality of fluid-operated torque tools are used, each engaging with a respective of one threaded connector. It is sensed when at least one of the fluid-operated torque tools reaches a point during an advance stroke when it permits a return ratcheting, and automatically all pistons of all fluid-operated torque tools are retracted even if a rest of the pistons or the fluid-operated torque tools are not advanced to a point when the return ratcheting of the tools is permitted.

9 Claims, 1 Drawing Sheet

METHOD OF AND AN APPARATUS FOR TIGHTENING THREADED CONNECTORS

BACKGROUND OF THE INVENTION

The present invention relates to a method of and a system for tightening threaded connectors, such as bolts, nuts, etc.

More particularly it relates to a method of and a system for tightening of threaded connectors with the use of a plurality of fluid operated torque tools. Methods of the above mentioned general type are known in the art. Such methods have to be further improved.

It should be understood that since the replacement of asbestos gaskets in industry, the gaskets which are used now are very sensitive. If one of the gaskets is squashed by mistake, the flange has to be disassembled again to replace the damaged gasket. This happens quite frequently in assembly or becomes visible as a result of a later leakage.

The problem with tightening flanges is that the tool flange faces are usually not parallel to one another. When torquing the bolts with one tool, the job has to be done in increments of 25, 50, 75 100% of the desired torque in a criss-cross manner, so as to bring down the flange faces and then to apply the load to the bolts via torque. This is extremely time-consuming.

When torquing with multiple tools, the bolts on the closed end become tighter while the bolts on the open end are still relatively loose. This causes crushing of the gasket and later leakage. When using hydraulic tensioners in multiples around the flange, each one applies the same identical loads to the bolts while stretching the bolts. This also means that the closed end of a flange obtains the same load as the open end of the flange initially. This could crush the gasket before the flange faces become parallel to each other. As the gap between the flange faces looks parallel even when it is not so, a way had to be found to automatically bring down the open end first without applying any force to the closed end.

SUMMARY OF THE INVENTION

Accordingly, it is an object of present invention to provide a method of and an apparatus for tightening threaded connectors, which avoids the disadvantages of the prior art.

In keeping with these objects and with others which will become apparent hereinafter, one feature of present invention resides, briefly stated, in a method of tightening threaded connectors which include the steps of using a plurality of fluid-operated torque tools each engaging with a respective of one threaded connectors; sensing when at least one of the fluid-operated torque tools reaches a point during an advance stroke when it permits a return ratcheting; and automatically retracting all pistons of all fluid-operated torque tools even if a rest of the pistons of the fluid operated torque tools is not advanced to a point when the return ratcheting of the tools is permitted.

It is another object of present invention to provide a system for tightening threaded connectors which includes a plurality of fluid-operated torque tools each engaging with a respective of one threaded connectors; sensing means operative for sensing when at least one of the fluid-operated torque tools reaches a point during an advance stroke when it permits a return ratcheting; and means for automatically retracting all pistons of all fluid-operated torque tools even if a rest of the pistons or the fluid operated torque tools is not advanced to a point when return ratcheting of the tools is permitted, comprising a plurality of fluid operated torque tools.

When the method is performed and the system is designed in accordance with the present invention, the flange faces are brought together so that they become and stay parallel to each other. The nut that is the loosest always turns so that all nuts are only turned simultaneously when the load applied to their bolts is close to equal. The looser nuts will always be brought up to the level of the tighter nuts, yet the tighter nuts will never keep the flange out of parallelism as all nuts are on hand-tight to begin with. In other words, even parallel flanges have a tendency to settle, thus becoming uneven again. With the present invention, the open end will at all times get the torque, while the close end has no torque applied until they become parallel, at which point all bolts are at equal load, all nuts get torqued and the flange faces are brought together with equal compression in circumference.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
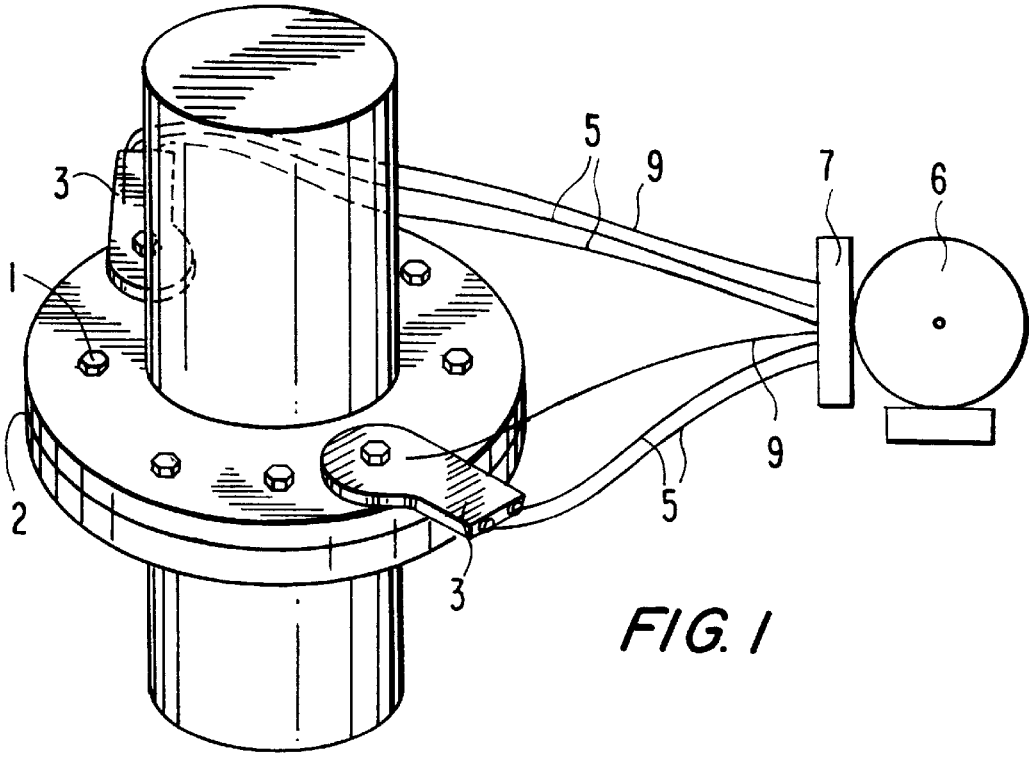
FIG. 1 is a view schematically showing a system for tightening a plurality of threaded connectors.
Figure 2:
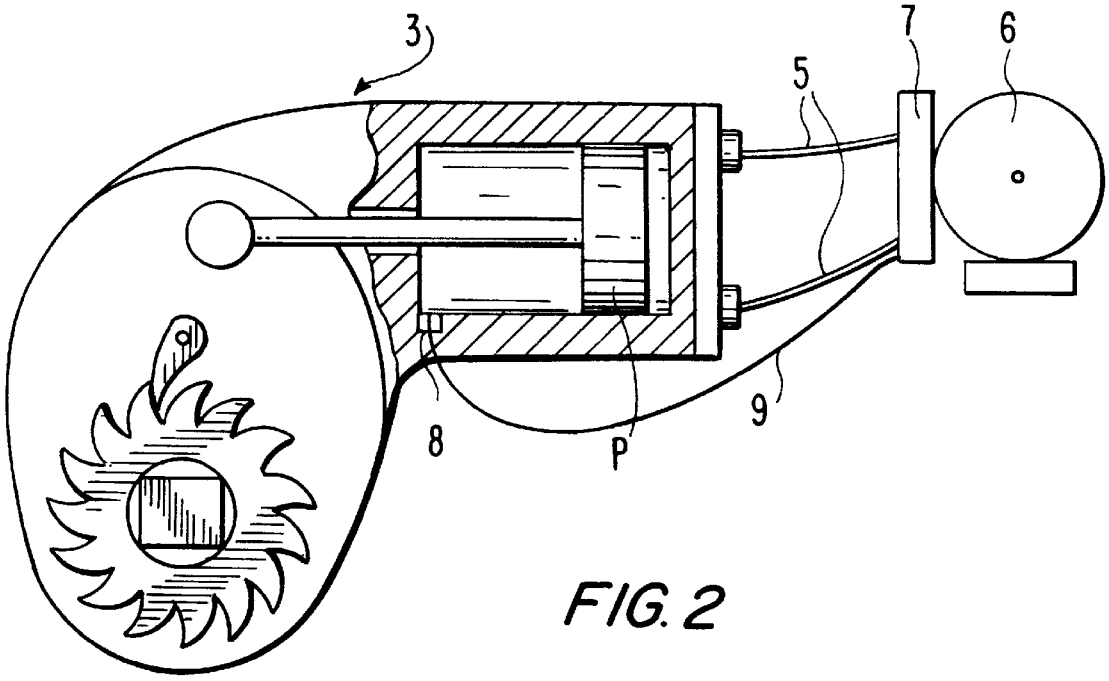
FIG. 2 is a view showing a detail of each fluid-operated tool which is used in the system.

A method and a system in accordance with the present invention are used for tightening a plurality of threaded connectors which are identified with reference numeral 1, for example on the flange which is identified with reference numeral 2. Each threaded connector can be formed by a bolt extending through a corresponding hole of the flange, and a nut screwed on the bolt. The threaded connectors 1 are located usually at equal distances from one another of the flange 2.

A plurality of fluid-operated tools 3 are provided for simultaneously tightening the threaded connectors 1, in particular the nuts. Each fluid-operated tool has a design which is well known in the art. In particular, it can have a fluid-operated drive, which includes a cylinder, a piston movable in the cylinder under the action of a fluid admitted in the cylinder, and a piston rod extending from the piston outwardly of the cylinder, which piston drive can be accommodated in one housing portion. A lever-ratchet mechanism is connected to the piston rod and usually has a drive link connected with the piston rod, a ratchet mounted in the drive link, a pawl arranged on the drive link and turning the ratchet during turning of the link, all connected to another housing portion. The ratchet has an inner opening or a projection for engaging a threaded connector and turning the same. For turning the nuts of the threaded connectors 1 on flange 2, the ratchets of the fluid-operated tools 3 are fitted with their openings over the nut.

Each fluid-operated tool 3 is connected through a swivel connector and a hose 5 to a hydraulic pump 6, or more particularly to a directional control valve 7 of the pump 6.

In accordance with the present invention, the system is provided with sensing means which operate in a special inventive manner. In particular, the sensing means can include a sensor 8 provided in each fluid operated tool 3 and operative for sensing during operation than a piston of the corresponding fluid-operated tool advances to a point when it permits return ratcheting. Specifically, the sensing means 8 can sense when the piston p of the fluid-operated tool 3 reaches its final point during the advanced stroke, after which the piston will perform a return stroke. During the return stroke of the piston, the lever-ratchet mechanism executes the return ratcheting. The sensor of the sensing means can be formed in many various modifications. For example, the sensor can be formed as a magnetic sensor-switch which senses when the piston p passes by and produces a corresponding signal. An electric cord 9 electrically connects the sensor 8 with the directional control valve 7 of the hydraulic pump 6.

The system in accordance with the present invention operates in the following way manner:

When the sensor 8 of at least one fluid-operated tool 3 senses that the piston of the fluid-operated tool reaches the point where it permits return ratcheting, the valve 7 is actuated so that all pistons of all fluid-operated tools 3 are automatically retracted, even if the rest of the pistons of the fluid-operated tools did not reach the point when return ratcheting is permitted.

The sensor 8 in accordance with the present invention can be operate in many different ways. While the sensor means shown in the drawings is formed as a magnetic sensor-switch which senses when the piston goes by and produces an electrical signal, the sensor means can be also formed as a magnetic switch which senses when a first holding pawl of the tool falls in a gap between the teeth of the ratchet, etc. Regardless of the specific construction of the sensor-switch, it must be designed so as to sense when an advance stroke is finished, and the tool is ready for return ratcheting.

It will be understood that each of the elements described above, or two or more together, may also find a useful application in other types of methods and constructions differing from the types described above.

While the invention has been illustrated and described as embodied in a method of and an apparatus for tightening threaded connectors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A method of tightening threaded connectors comprising using a plurality of fluid-operated torque tools each engaging with a respective of one threaded connectors; sensing when at least one of the fluid-operated torque tools reaches a final point during an advance stroke when it permits a return ratcheting; and automatically retracting all pistons of all fluid-operated torque tools even if a rest of the pistons of the fluid-operated torque tools is not advanced to a point when the return ratcheting of the tools is permitted.

2. The method as defined in claim 1, wherein said engaging includes arranging the fluid-operated torque tools equally distantly from one another around a bolt circle for engaging nuts of the threaded connectors.

3. The method as defined in claim 1, wherein said sensing includes sensing a position of the piston of the at least one fluid-operated tool when it finishes its advance stroke for starting the return ratcheting.

4. The method as defined in claim 1, wherein said sensing includes sensing when a pawl of me lever-ratchet mechanism of the at least one fluid operated tool falls into teeth of the ratchet.

5. The apparatus as defined in claim 1; and further comprising a single fluid source for supplying all the fluid-operated tools; and a control valve associated with the source and operative for providing a supply of fluid from said source to said fluid-operated tools and to interrupt the supply.

6. An apparatus for tightening threaded connectors comprising a plurality of fluid-operated torque tools each engaging with a respective of one threaded connectors; sensing means operative for sensing when at least one of the fluid-operated torque tools reaches a final point during an advance stroke when it permits a return ratcheting; and means for automatically retracting all pistons of all fluid-operated torque tools even if a rest of the pistons of the fluid-operated torque tools are not advanced to a point when return ratcheting of the tools is permitted.

7. The apparatus as defined in claim 6, wherein said fluid operated torque tools are arranged equally distantly from one another around a bolt circle for engaging nuts of the threaded connectors.

8. The apparatus as defined in claim 7, wherein said sensing means is formed so as to sense a position of the piston of the at least one fluid-operated tool when it finishes its advance stroke for starting the return ratcheting.

9. The apparatus as defined in claim 7, wherein said sensing means is formed so as to sense when a pawl of the lever-ratchet mechanism of the at least one fluid-operated tool falls into teeth of the ratchet.

* * * * *